United States Patent [19]

Wood

[11] Patent Number: 4,458,365

[45] Date of Patent: Jul. 10, 1984

[54] NURSING GOWN OR GARMENT

[76] Inventor: Mary E. Wood, 969 Curtis St., Albany, Calif. 94706

[21] Appl. No.: 488,049

[22] Filed: Apr. 25, 1983

[51] Int. Cl.[3] ..... A41D 1/20

[52] U.S. Cl. ..... 2/104

[58] Field of Search ..... 2/104, 105, 114, 74, 2/DIG. 7

[56] References Cited

U.S. PATENT DOCUMENTS

| | | | |
|---|---|---|---|
| 697,576 | 4/1902 | Walter et al. | 2/104 |
| 778,014 | 12/1904 | Coyle | 2/114 |
| 1,206,480 | 11/1916 | Stagg | 2/104 |
| 1,489,046 | 4/1924 | Thompson | 2/114 |
| 2,124,366 | 7/1938 | Lasarte | 2/114 |
| 2,319,089 | 5/1943 | Severance | 2/114 |
| 2,680,850 | 6/1954 | Renard | 2/74 |
| 2,701,364 | 2/1955 | Palm | 2/114 |
| 3,154,789 | 11/1964 | Lewis, Jr. | 2/104 |
| 3,155,984 | 11/1964 | Derrick | 2/114 |
| 3,160,891 | 12/1964 | MacDonald | 2/69 |
| 3,423,761 | 1/1969 | Nickerson | 2/104 |
| 3,464,063 | 9/1969 | Hoegerman | 2/114 |
| 3,490,072 | 1/1970 | Keltner | 2/114 |
| 3,611,439 | 10/1971 | Meyers | 2/104 |
| 3,751,730 | 8/1973 | Zamist | 2/114 |
| 4,144,593 | 3/1979 | Timmons | 2/104 |
| 4,208,743 | 6/1980 | Whitcraft | 2/104 |

*Primary Examiner*—Doris L. Troutman

*Attorney, Agent, or Firm*—Manfred M. Warren; Robert B. Chickering; Glen R. Grunewald

[57] ABSTRACT

A gown 19 for nursing mothers that includes a body portion 21 with sleeves 23 at each side. The body portion of the gown has an opening 27 down the back of the gown that is closed by closure ties 29 and 53. In the front of the gown, the body portion covers the patient's torso from the breasts downward. An upper portion 34 of the gown extends downward from the shoulders to the patient's waist and is sewn to the body portion of the gown in a region 39 adjacent to the patient's sternum. The upper portion forms two flaps 35 and 37 that extent downward from the sewn region. Access to the patient's breast is gained by simply raising a flap. Ties 47 and eyelets 51 are provided to secure the flaps in the raised position. Elastic 33 is sewn into the upper edge 31 of the front of the body portion to keep to gown in position under the patient's breasts.

3 Claims, 3 Drawing Figures

NURSING GOWN OR GARMENT

BACKGROUND OF THE INVENTION

The present invention relates generally to wearing apparel such as night gowns or lounging gowns and relates more specifically to a garment suitable for use by nursing mothers either in a hospital or at home.

Gowns for hospital patients should meet certain criteria that are necessitated by the hospital environment. Since many patients have limited mobility, the gowns must be easy to put on. Buttons, snaps, and other fasteners are not normally used on hospital gowns as they may fall off or effect the quality of X-ray photographs. Patient comfort is a primary concern as well as cost and durability.

A conventional type of hospital gown has a full length opening at the rear which is closed by a closure tie at the neck. With this type of gown, it is easy to clothe even an invalid patient since the gown need not be stepped into nor put on over the patient's head. The wide sleeves of this type of gown allow access to the patient's arm. This type of gown is comfortable for the patient since it is loose fitting and covers the patient's torso and upper arms to insulate from drafts and cold air.

Such conventional hospital gowns, however, are quite awkward for mothers to use in the hospital when breast feeding their babies. The major difficulty with the gown is that a patient can not easily expose a breast for feeding. Removal or reversal of the gown is unsuitable because a nurse is needed to assist the patient by removing any intravenous tubing and untying the closure tie. This is undesireable because it wastes valuable professional time, and the patient's body is exposed to the view of others, thus invading her privacy. Alternative methods of breast access involving untying the gown and pulling it down or pulling it up or around also needlessly expose the patient's body.

Hospital gowns have existed in the prior art that are releaseably joined at the shoulder seam and permit a front panel to be dropped for breast access. Gowns of this type were described in the following U.S. Pat. Nos. 1,489,046 issued Apr. 1, 1924 to H. F. T. Thompson; 2,701,364 issued Feb. 8, 1955 to C. B. Palm; 3,464,063 issued Sept. 2, 1969 to H. J. Hoegerman; and 3,490,072 issued Jan. 20, 1970 to R. O. Keltner. Mechanical fasteners were used at the shoulder seam to fasten the front panels of all of the gowns described in the above patents with the exception of Keltner which used adhesive strips. All of these gowns suffered from the disadvantage that the patient's entire breast and shoulder would necessarily be exposed during breast feeding. Additionally, the Hoegerman and the Keltner gowns were sleeveless which would not sufficiently cover the patient and, thus, would not be suitable for hospital wear.

Hospital and nursing gowns have existed that have openings covered by flaps to permit access to the breast area. See for example U.S. Pat. Nos. 778,014 issued Dec. 20, 1904 to R. T. Coyle; and 2,124,366 issued July 19, 1938 to A. F. de Lasarte. One common disadvantage of the Coyle and de Lasarte gowns is that they both used buttons to fasten their flaps in a closed position. Additional disadvantages were that the Coyle gown restricted breast access through a narrow opening, and that the de Lasarte gown was of two piece construction including a cape in addition to a sleeveless gown. As a result, these gowns were impractical for use in hospitals.

Hospital gowns and the like have existed that have flaps covering the breast area but without fasteners to retain the flaps. Examples of this type of gown construction may be found in U.S. Pat. Nos. 2,319,089 issued May 11, 1943 to L. Severance and 3,751,730 issued Aug. 14, 1973 to S. Zamist. The Severance gown included a inner front panel of fabric with cut-outs for access to the breast area plus an outer front panel, joined to the inner front panel above and below the breasts, to cover the cut-outs and the breasts. To gain access to the breast, the outer panel was moved to the center, exposing the cut-out area in the inner panel. Disadvantages to the Severance gown included restricted access to the breasts due to the joining of the inner and outer panels, and overall construction complexity. The Zamist gown was a wrap-around toga with cut-outs at the breast area with a flap hanging down over the cut-outs. Since the Zamist gown was sleeveless, it was not suitable for hospital useage.

Additional types of hospital gowns without fasteners are known to exist in the prior art, as exemplified by U.S. Pat. Nos. 3,155,984 issued Nov. 10, 1964 to D. L. Derrick and 3,160,891 issued Dec. 15, 1964 to G. E. MacDonald. Both the Derrick and the MacDonald gowns were intended to be examination gowns to be worn temporarily rather than as a general patient gown. Their sleeveless construction and lack of access to the breast area made them unsuitable as hospital gowns for nursing mothers.

In summary, the prior art discloses several hospital gowns for nursing mothers, none of which are optimal from the criteria of patient comfort, breast access with a minimum of exposure, ease of ingress, and lack of fasteners.

SUMMARY OF THE INVENTION

A. Objects of the Invention

Accordingly, it is an object of the present invention to provide an improved gown that is suitable for use by nursing mothers and that minimizes patient exposure and inconvenience during breast feeding.

It is another object of the present invention to provide a garment for nursing mothers that permits ready access to the breast area without requiring assistance.

It is a further object of the present invention to provide a garment for nursing mothers that is easy to put on and comfortable to wear.

It is still another object of the present invention to provide a nursing gown that is simply constructed and is suitable for both home and hospital use.

B. Brief Summary of the Invention

A gown for nursing mothers, according to the present invention, includes a body portion with sleeves at each side. The body portion of the gown has an opening down the back of the gown that is closed by a closure tie located behind the patient's neck. In the front of the gown, the body portion covers the patient's torso from the breasts downward. An upper portion of the gown extends downward from the shoulders to the patient's waist and is sewn to the body portion of the gown near the patient's sternum. The upper portion forms two flaps that extent downward from the sewn region, covering the breasts. Access to the patient's breast is gained by simply raising a flap. Ties are provided to secure the flaps in the raised position.

Among the several advantageous features of the present invention are the maintenance of patient privacy by the concealing nature of the flaps. Another feature of the present invention is that the gown, in most cases, permits ready access to the patient's breasts without assistance. Still another feature of the present invention is its simple construction.

The hospital gown for nursing mothers according to the present invention has other objects and features which will be apparent from and are set forth in more detail in the accompanying drawing and the following description of the preferred embodiment.

DESCRIPTION OF THE PREFERRED EMBODIMENT

Figure 1:
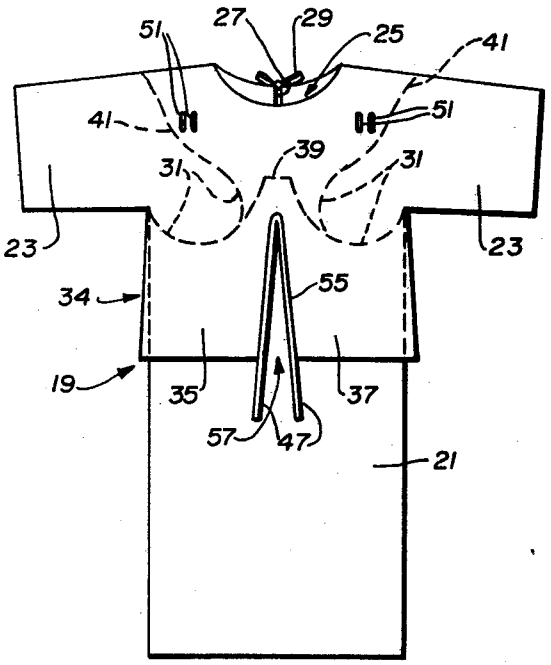
FIG. 1 is a front elevational view of a gown constructed in accordance with the present invention.

In reference to FIGS. 1, the construction and function of a gown 19 for nursing mothers according to the present invention will now be described. Gown 19 includes a body portion 21 from which sleeves 23 extend. The body portion 21 is formed with a neck opening 25 and a back opening 27 that is held together by a closure tie 29. The opening 27 extends down the entire length of the back of the gown to permit it to be put on without pulling the gown over the head of the patient. As will be understood, however, it is possible to eliminate back opening 27.

In the gown of the present invention, the body portion 21 terminates at 31 at the front of the gown in arcuate openings which are positioned immediately proximate and underneath the breasts of a female patient who would use the gown, except for centrally extending strip portion 39 which extends upwardly toward neck opening 25. As best may be seen in FIG. 2, an elastic member 33 preferably extends along opening 31 so as to keep the gown relatively close to the body underneath the user's breasts.

Extending downwardly over openings 31 is an upper portion 34 of the gown 19 including two flaps 35 and 37. As will be seen from FIG. 1, flaps 35 and 37 fully cover openings 31. A yoke 41 also extends down from neck 25 in the front of body portion 21 and is sewn or otherwise secured to strip portion 39 underneath flaps 35 and 37. This securement of the upper portion of the gown to the body portion maintains the openings 31 in position underneath the breasts, with flaps 35 and 37 covering the breasts when in the position of FIG. 1.

Figure 2:
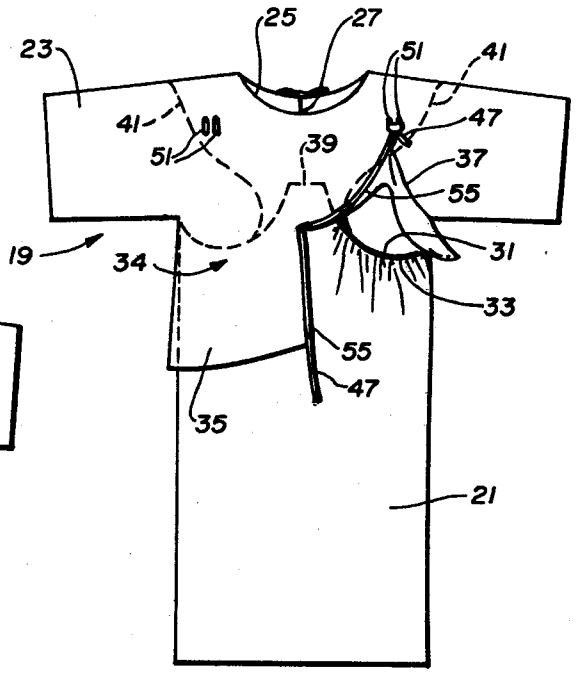
FIG. 2 is a front elevational view of the gown of FIG. 1 with a moveable flap shown in a raised position.

In FIG. 2, it will be seen that flap 37 has been raised, and a tie 47 passed through button-like eyelets 51 formed in upper portion 34 of the garment so as to secure the same in close proximity to the neck line. As thus located, the flap now is raised to expose the breast of the user for nursing or, in the case of hospital patients having had surgery, other auxiliary treatment. Flap 35 is similarly formed with a tie 47 which can be secured to eyelets 51 proximate the neck line 25 of the gown. Thus, a selected one or both of the patient's breasts can be easily exposed without tortured manipulation of the gown and without unnecessarily exposing the rest of the patient. The privacy and warmth provided by the gown, therefore, is greatly enhanced over a conventional nursing gown.

In order to enhance safety by minimizing the likelihood of accidentally pulling ties 47 off the gown, it is preferable that ties 47 be formed by one continuous strip 55 which is sewn up one side and down the other of V-shaped groove 57 defining flaps 35 and 37.

Figure 3:
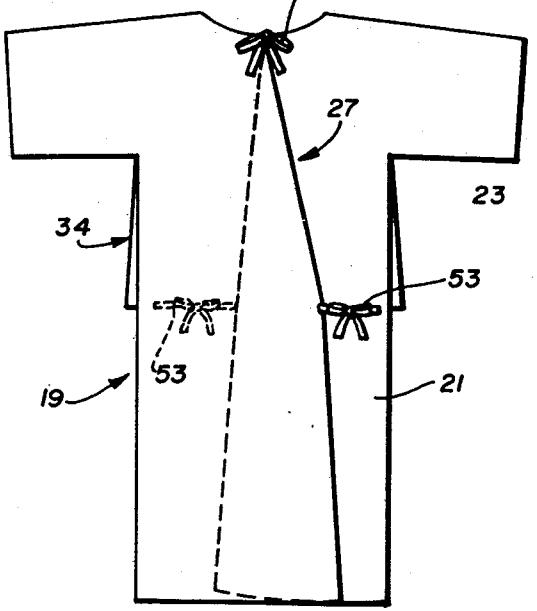
FIG. 3 is a rear elevational view of the gown of FIG. 1.

As will be appreciated, it is possible to reverse various components of the gown. For example, the ties 47 can be positioned at the neck line and eyelets 51 positioned at the bottom corners of the flaps 35 and 37. It is also preferable to form the gown, as shown in FIG. 3, with a back which overlaps and is held together by ties 53, although this construction is optional. As will also be understood, the gown of the present invention can be made in various sizes and from various types of material conventional for use in hospital gowns or home lounging gowns.

What is claimed is:

1. A nursing gown including a body portion disposed for covering the torso of a patient, said body portion having an opening at the rear thereof for patient ingress and an upper edge at the front thereof disposed proximate to and beneath the breasts of said patient said gown also including means for closing said opening and two sleeves disposed for covering the arms of said patient, wherein the improvement in said gown comprises:

flap means, affixed to said body portion adjacent the sternum area of said patient and extending downwardly from the shoulder portion of said body portion for selectively covering and uncovering said breasts and said upper edge of said body portion;

said flap means including two flaps extending from a point below said upper edge and downwardly toward the waist area of said patient, each of said flaps having a tie affixed thereto at the lower edge thereof.

2. A gown as defined in claim 1 wherein, said gown further includes eyelet means disposed adjacent the neck area of said patient for cooperating with said ties to selectively secure one or both flaps to permit breast access.

3. A gown as defined in claim 1 wherein, said ties are formed from a continuous strip of material sewn to edges defining said flaps.

* * * * *